US011396445B2

(12) United States Patent
Maldonado Nicolás et al.

(10) Patent No.: US 11,396,445 B2
(45) Date of Patent: Jul. 26, 2022

(54) FORK HEAD WITH GRIPPING DEVICE AND LATERAL MOVEMENT

(71) Applicant: SOLTEC ENERGÍAS RENOVABLES, SL, Molina de Segura (ES)

(72) Inventors: Juan José Maldonado Nicolás, Rincón de Seca (ES); Albert García Gil, Villanueva del Río Segura (ES); Francisco Juan Almela Béjar, Lorquí (ES)

(73) Assignee: SOLTEC ENERGIAS RENOVABLES, SL, Molina de Segura (ES)

( * ) Notice: Subject to any disclaimer, the term of this patent is extended or adjusted under 35 U.S.C. 154(b) by 0 days.

(21) Appl. No.: 17/285,468

(22) PCT Filed: Oct. 7, 2019

(86) PCT No.: PCT/ES2019/070676

§ 371 (c)(1),
(2) Date: Apr. 14, 2021

(87) PCT Pub. No.: WO2020/079296

PCT Pub. Date: Apr. 23, 2020

(65) Prior Publication Data

US 2021/0380383 A1 Dec. 9, 2021

(30) Foreign Application Priority Data

Oct. 16, 2018 (ES) ..... U201831560

(51) Int. Cl.
*B66F 9/14* (2006.01)
*B66F 9/18* (2006.01)

(52) U.S. Cl.
CPC . *B66F 9/14* (2013.01); *B66F 9/18* (2013.01)

(58) Field of Classification Search
CPC ..... B66F 9/18; B66F 9/14
See application file for complete search history.

(56) References Cited

U.S. PATENT DOCUMENTS 2,684,165 A * 7/1954 Hill ..... B66F 9/18 414/622
2,772,800 A * 12/1956 Brady ..... B66F 9/18 414/622

(Continued)

FOREIGN PATENT DOCUMENTS

CN 103010765 A 4/2013
CN 206901706 U 1/2018

(Continued)

OTHER PUBLICATIONS

International Search Report in patent application PCT/ES2019/070676 dated Jan. 14, 2020 by the Spanish Patent & Trademark Office, official translation provided.

(Continued)

*Primary Examiner* — Jonathan Snelting
(74) *Attorney, Agent, or Firm* — Thedford I. Hitaffer; Hitaffer & Hitaffer, PLLC

(57) ABSTRACT

Fork head for gripping thin objects having a main frame attached to a mobile element on a lifting vehicle; a mobile frame, with two fixed, parallel arms and a gripping arm that moves from and towards the fork arms to trap a thin object hanging between the two fork arms, said mobile frame being able to move horizontally along a transversal guide attached to the main frame; wherein the gripping arm has end portions superimposed on the two arms of the frame and has a length (L) in a transversal direction equal to or greater than a fork width (w) defined by the distance between the opposite outer edges of the two fork arms.

8 Claims, 5 Drawing Sheets

(56) References Cited

U.S. PATENT DOCUMENTS

| | | | | | |
|---|---|---|---|---|---|
| 2,807,382 | A | | 9/1957 | Schenkelberger | |
| 2,875,912 | A | * | 3/1959 | Thresher | B66F 9/125 414/622 |
| 2,959,313 | A | * | 11/1960 | Bettencourt | B66F 9/18 414/785 |
| 3,024,929 | A | * | 3/1962 | Shimmon | B66F 9/125 414/420 |
| 3,039,635 | A | * | 6/1962 | Drackett | B66F 9/18 414/662 |
| 3,438,525 | A | * | 4/1969 | Nutter | B66F 9/19 414/620 |
| 3,455,476 | A | * | 7/1969 | Grigsby | B66F 9/18 414/607 |
| 4,116,349 | A | | 9/1978 | Durham | |
| 4,354,795 | A | * | 10/1982 | Dutra, Jr. | B66F 9/18 294/67.22 |
| 5,184,934 | A | * | 2/1993 | Gallo | B66F 9/065 125/12 |
| 5,509,774 | A | * | 4/1996 | Yoo | B66F 9/18 414/622 |

FOREIGN PATENT DOCUMENTS

| | | | |
|---|---|---|---|
| JP | S56103599 | U | 8/1981 |
| JP | 2000327290 | A1 | 11/2000 |

OTHER PUBLICATIONS

Written Opinion in patent application PCT/ES2019/070676 dated Jan. 10, 2020 by the Spanish Patent & Trademark Office.

* cited by examiner

FORK HEAD WITH GRIPPING DEVICE AND LATERAL MOVEMENT

FIELD OF THE INVENTION

The present invention relates to a fork head with a gripping device and lateral movement, especially designed to grip thin objects, such as, for example, the large shafts used in single-axis solar tracker apparatuses.

PRIOR ART

In different tasks, such as installing single-axis solar trackers, it is necessary to manipulate large objects the length of which is much greater than the transverse section thereof, such as the shafts used in single-axis solar tracker apparatuses, which, merely by way of reference, can be tubes wish a 150×150 mm square profile, with varying wall thicknesses of between 3 and 6 millimeters, and with lengths of up to 13 meters. Alternatively, the shafts used in single-axis solar tracker apparatuses may consist of round profile tubes or any other transverse sectional profile, whether regular or irregular.

To manipulate these types of thin objects, several people are required if the operation is done manually. When a lifting vehicle is used, such as a forklift with a fork head or the like, a special grip is necessary for holding and stabilizing the thin object to the fork head of the lifting vehicle.

CN 206901706 U discloses a fork head with a gripping and lateral movement device. The head includes a main frame intended to be fixed to a moving element of an elevator vehicle, a mobile frame movable by a first actuator along a transverse guide fixed to the main frame, two parallel fork arms fixed to the mobile frame, a gripping member pivotally mounted about a horizontal axis supported on the mobile frame, and a second actuator which pivots the gripping element relative to the mobile frame to trap a thin object in a hanging position between the gripping member and the two fork arms.

The gripping member described in said CN 206901706 U has a length in a direction transverse to the fork arms significantly shorter than the spacing between the two fork arms so that the gripping member can pass between the fork arms. This is a disadvantage since it can produce undesired bending deformations in the thin object when it is pressed by the gripping member at an intermediate point between two support points provided by the fork arms.

Accordingly, there is a need for a device that makes it possible to grip thin objects, such as tubes the length of which is much greater than the transverse section thereof, from a fork head of an elevator vehicle. There is also a need for a device that makes it possible to laterally move the gripping member together with the fork arms relative to a main frame of the head.

DISCLOSURE OF THE INVENTION

The present invention contributes to the above and other needs by providing a fork head with a gripping and lateral movement device for gripping thin objects, wherein the head comprises a main frame intended to be fixed to a moving element of an elevator vehicle, a mobile frame movable horizontally by a first actuator along a transverse guide fixed to the main frame, a fork having two parallel fork arms fixed to the mobile frame, and a gripping member mounted on the mobile frame and movable by a second actuator to and from the fork for trapping a thin object in a hanging position between the gripping member and the two fork arms.

The gripping member has a length in a transverse direction equal to or greater than a fork width defined as a distance between respective opposing outer edges of the two fork arms. Accordingly, the gripping member has end portions superimposed on to portions of the two fork arms.

With this arrangement, the thin object is pressed by the end portions of the gripping member against the corresponding portions of the fork arms, which ensures a firm and stable grip of the thin object without the grip producing bending stresses which can result in undesired deformations in the thin object.

In addition, the thin object, once gripped, can be moved laterally with respect to the main frame of the head by means of the first actuator, which facilitates precise positioning of the thin object via the lifting vehicle.

In a preferred embodiment the gripping member is movable along one or more linear guides fixed to the mobile frame, wherein the linear guides are perpendicular to a support member plane defined by upper surfaces of the two fork arms. The support member plane is usually horizontal or approximately horizontal and the linear guides are vertical or approximately vertical.

In a preferred embodiment, each of the linear guides is a guide having a guide body connected to the mobile frame and a telescoping rod connected to the gripping member and slidably inserted into the guide body. In an alternative embodiment the linear guides have a reverse arrangement in which the guide body is connected to the gripping member and the telescopic rod is connected to the mobile frame. Alternatively, any other guide device for the linear guides may be used.

Preferably, the first actuator is a first hydraulic cylinder having a cylinder body connected to the main frame and an extendable rod connected to the mobile frame. An inverse arrangement is equally possible in which the body of the first hydraulic cylinder is connected to the mobile frame and the extendable rod is connected to the main frame. Alternatively, any other type of motor associated with transmission of mechanical movement may be used for the first actuator.

Preferably, the second actuator or each second actuator is a second hydraulic cylinder having a cylinder body connected to the mobile frame and an extendable rod connected to the gripping member. An inverse arrangement is equally possible, in which the body of the second hydraulic cylinder is connected to the gripping member and the extendable rod is connected to the mobile frame. Alternatively, any other type of motor associated with transmission of mechanical movement may be used for the second actuator.

In an alternative embodiment, the gripping member is fixed to a movable arm having a pivotal movement about a horizontal axis, and the second actuator is a second hydraulic cylinder having a cylinder body connected to the mobile frame and an extendable rod connected to the movable arm or vice versa, or any other suitable motor means.

Preferably, the gripping member comprises a flat pressure plate parallel to the support member plane or a pressure plate configured in a direction parallel to the support member plane. In any event, the shape of the pressure plate is adapted to the particular shape of an outer surface of the thin object determined by the shape of the transverse sectional profile thereof.

Optionally, and in particular when the pressure plate is flat, the gripping member includes a leading skirt perpendicular to the pressure plate, and consequently perpendicular to the support member plane, extending downwardly from a forward transverse edge of the pressure plate. Optionally, the gripping member further comprises a rear rib extending upwardly from a rear transverse edge of the pressure plate.

BRIEF DESCRIPTION OF THE DRAWINGS

The aforementioned and other features and advantages will be more fully understood from the following detailed description with no limiting effect of an example embodiment with reference to the accompanying drawings, wherein.

DETAILED DESCRIPTION OF AN EMBODIMENT

Figure 1:
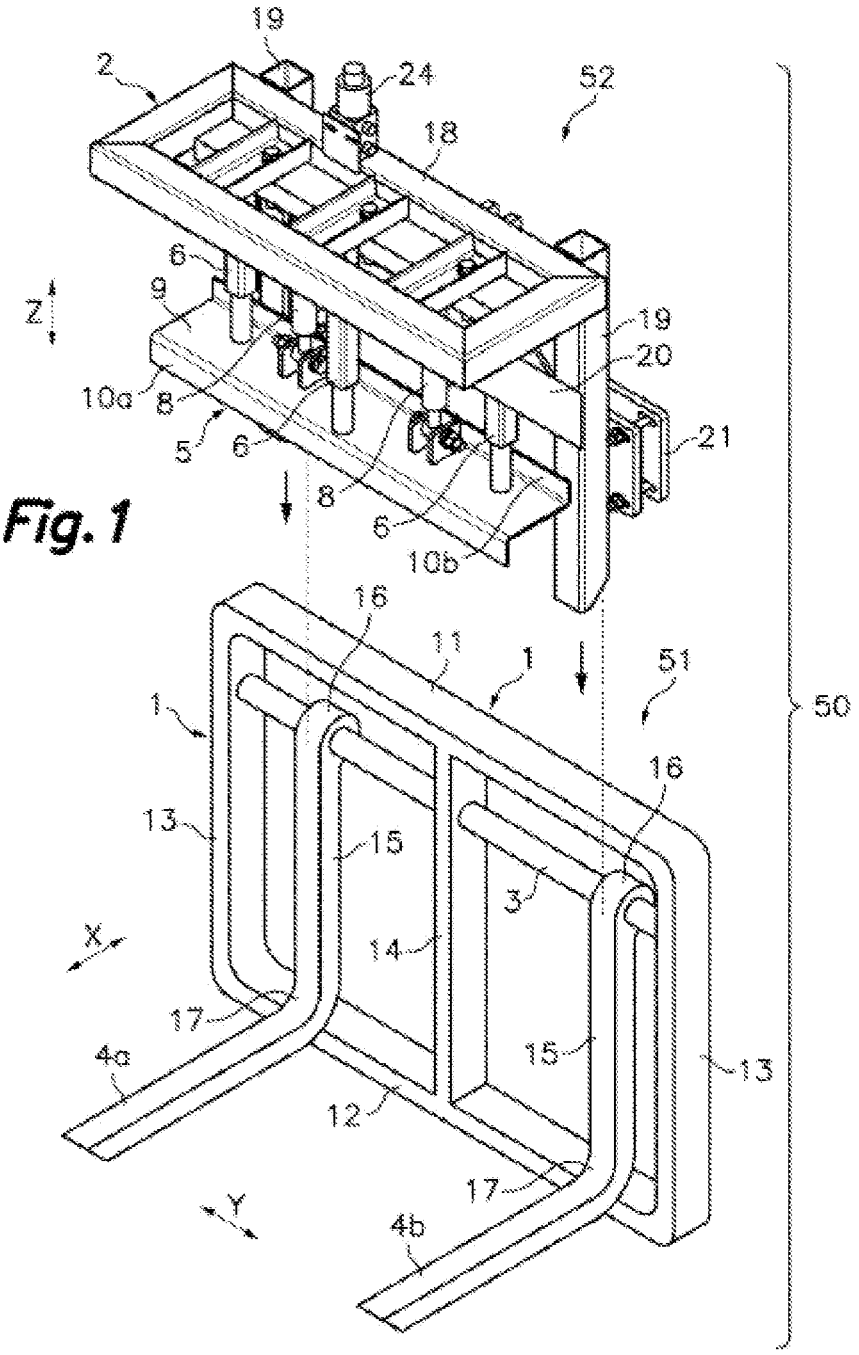
FIG. 1 is a perspective view of a partial exploded view of a fork head with a gripping and lateral movement device for gripping thin objects in accordance with an embodiment of the present invention.
Figure 2:
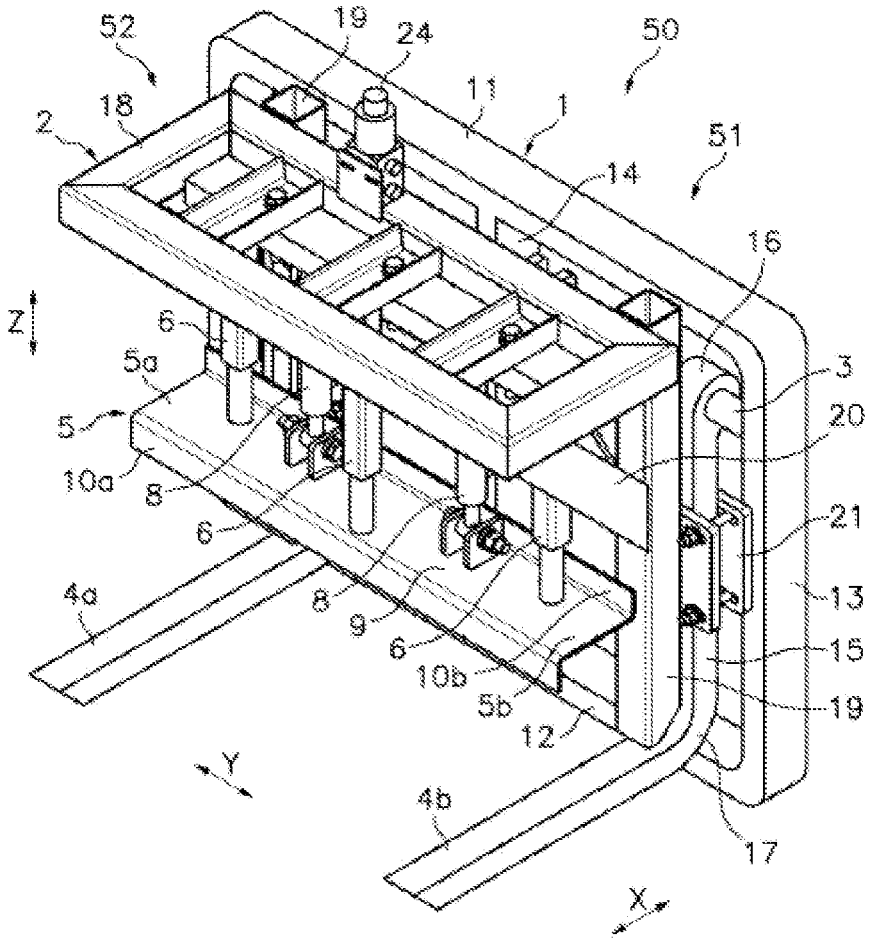
FIG. 2 is a perspective view of the assembled fork head of FIG. 1 with a gripping member in an inactive position.

Referring first to FIG. 1, the reference sign 50 generally designates a fork head with a gripping and lateral movement device according to one embodiment of the present invention, which is intended to grip and manipulate objects in a stable and safe manner. The fork head 50 comprises a first subassembly 51 and a second subassembly 52.

The first subassembly 51 of the fork head 50 includes a main frame 1 intended to be fixed to a mobile element of a lifting vehicle via anchors (not shown), a transverse guide 3 fixed to the main frame 1 and two fork arms 4*a*, 4*b* arranged so that they can be moved together along the transverse guide 3. The fork arms 4*a*, 4*b* are parallel to a longitudinal direction X corresponding to a rear direction of the lifting vehicle and thus parallel to a direction of movement of the lifting vehicle. The transverse guide 3 is oriented in a transverse Y and horizontal direction y and perpendicular to the longitudinal direction X.

In the illustrated embodiment, the main frame 1 defines a peripheral frame having an upper bar 11, a lower bar 12, two end posts 13 and a central post 14 extending from the upper bar 11 to the lower bar 12. The upper and lower bars 11, 12 are oriented in the transverse direction Y. The two end posts 13 and the central post 14 are oriented in a vertical direction Z perpendicular to the longitudinal direction X and to the transverse direction Y. The transverse guide 3 has two circular transverse sections extending from each of the end posts 13 to the central post 14.

Each fork arm 4*a*, 4*b* is rigidly attached to one end of a respective vertical element 15 having at its other end a connecting element 16 provided with a circular opening through which the corresponding section of the transverse guide 3 is inserted so that the fork arms 4*a*, 4*b* can slide and pivot freely with respect to the transverse guide 3. Between each fork arm 4*a*, 4*b* and the corresponding vertical element 15 thereof there is a curved transition section 17 that interferes with the lower bar 12 of the main frame to limit the pivoting of the fork arm 4*a*, 4*b*.

The second subassembly 52 of the fork head 50 comprises a mobile frame 2 having an upper horizontal structure 18 and two rear posts 19 oriented in the vertical direction Z. The two rear posts 19 are fixed to the upper frame 18 engaging with braces 20. Each of the rear posts 19 has a first bracket 21 configured to be attached to one of the vertical elements 15 which in turn are attached to the fork arms 4*a*, 4*b*. Thus, the first subassembly 51 can slide and pivot together with the fork arms 4*a*, 4*b* along the transverse guide 3.

Between the first subassembly 51 and the second subassembly 52 is a first actuator, which, in the illustrated embodiment, is comprised of a first hydraulic cylinder 7 having a cylinder body connected to a support member 22 which has a second bracket 23 fixed to the central post 14 of the main frame 1 and an extendable rod connected to one of the rear posts 19 of the mobile frame 2.

Alternatively, the connection of the first hydraulic cylinder 7 could be reversed, i.e., with cylinder body connected to the rear post 19 and extendable rod connected to the support member 22.

Both the first brackets 21 and the second bracket 23 include tightening screws by which it is possible to adjust the position of the second subassembly 52 relative to the first subassembly 51 in the vertical direction Z.

With this construction, activating the first hydraulic cylinder 7 moves the second subassembly 52 horizontally together with the fork arms 4*a*, 4*b* with respect to the main frame 1 of the first subassembly 51 along the transverse guide 3 parallel to the transverse direction Y.

The second subassembly 52 comprises a mobile gripping member 5 installed on the mobile frame 2 in a position facing the upper surfaces of the two fork arms 4*a*, 4*b* defining a support member plane. The gripping member 5 comprises a pressure plate 9 parallel to the support member plane. The pressure plate 9 has front and rear transverse edges parallel to the transverse direction Y. The gripping member 5 further comprises a front skirt 10*a* perpendicular to the pressure plate 9 which extends downwardly from the front transverse edge of the pressure plate 9 and a rear rib 10*b* extending upwardly from the rear transverse edge of the pressure plate 9.

The gripping member 5 can be moved in the vertical direction Z along the linear telescopic guides 6 by means of second actuators, such as second hydraulic cylinders 8. The linear guides 6 are perpendicular to the pressure plate 9 and consequently parallel to the vertical direction Z. Each of the linear guides 6 has a guide body connected to the mobile frame 2 and a telescopic rod slidably inserted into the guide body and connected to the gripping member 5. The second hydraulic cylinders 8 have a cylinder body connected to the mobile frame 2 and an extendable rod connected to the gripping member 5.

Alternatively, the connection of the linear guides 6 could be reversed, i.e., with the guide body connected to the gripping member 5 and the telescopic rod connected to the mobile frame 2. Alternatively, the connection of the second hydraulic cylinders 8 could be reversed, i.e., with the cylinder body connected to the gripping member 5 and the extendable rod connected to the mobile frame 2.

Thus, activating the second hydraulic cylinders 8 in a first direction causes a movement of the gripping member 5 toward the fork arms 4*a*, 4*b* by a path sufficient to trap a thin object 40 between the gripping member 5 and the two fork arms 4*a*, 4*b*, the thin object 40 being arranged in a hanging position and oriented in a direction parallel to the transverse direction Y. Activating the second hydraulic cylinders 8 in a second opposite direction causes a movement of the gripping member 5 away from the fork arms 4*a*, 4*b* so as not to interfere with the thin object 40.

Mounted on the upper frame 18 of the mobile frame 2 is a six-way valve 24 connected to the first hydraulic cylinder 7 and to the second hydraulic cylinders 8 via flexible conduits (not shown) connectable to a hydraulic system of the lifting vehicle. The operation of the first hydraulic cylinder 7 and the second hydraulic cylinders 8 is controlled via the six-way valve 24.

Figure 3:
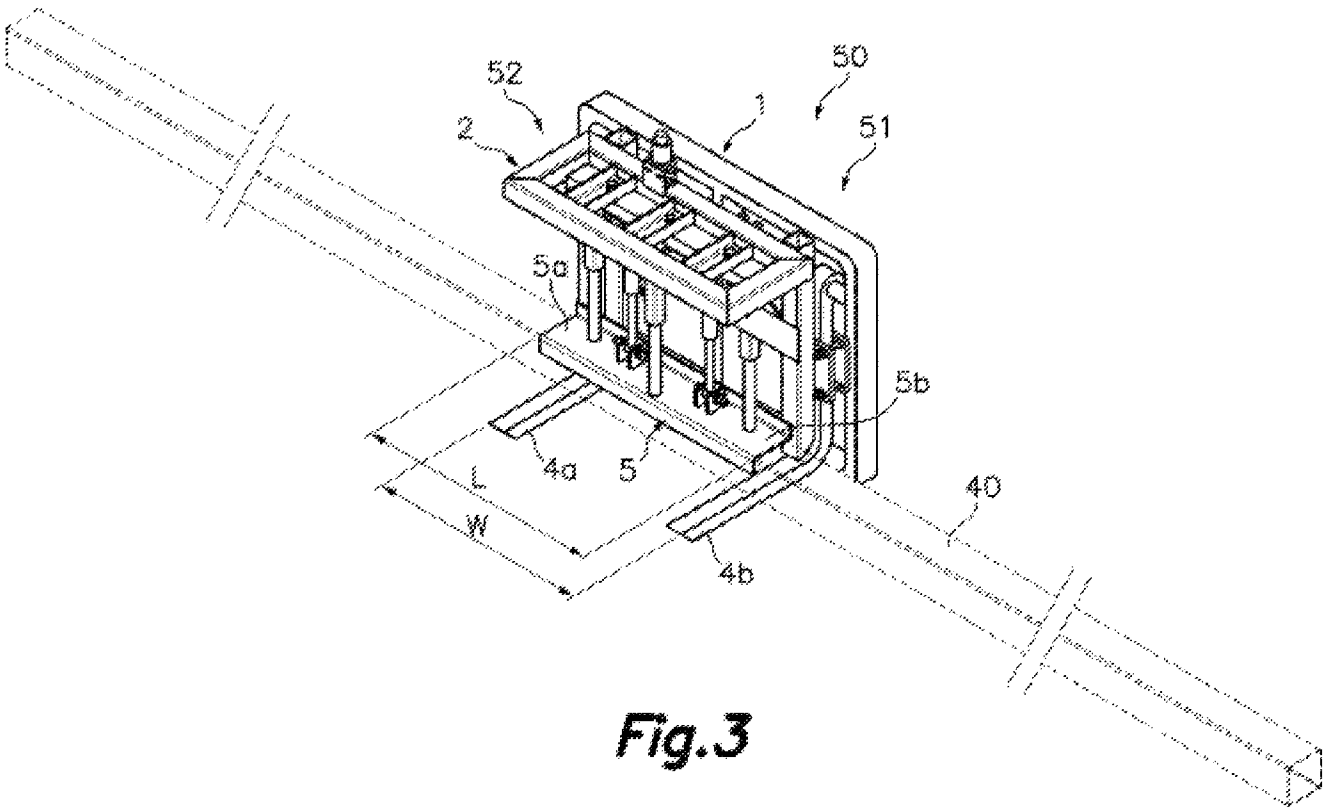
FIG. 3 is a perspective view of the fork head of FIG. 2 with the gripping member in an active position gripping a thin object.
Figure 4:
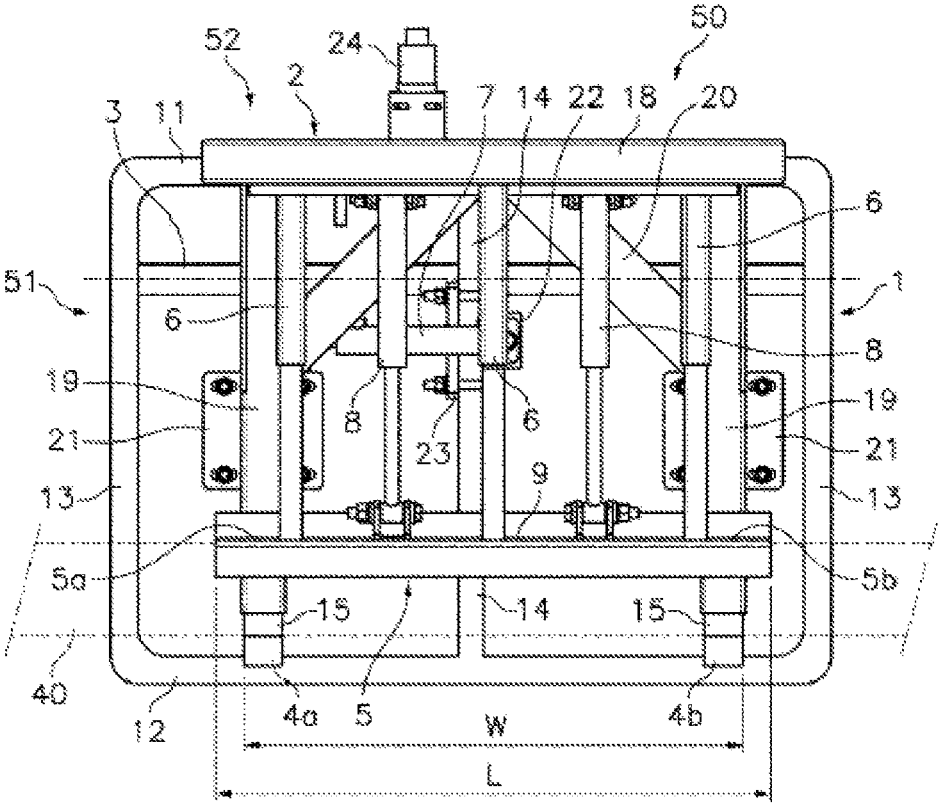
FIG. 4 is a front view of the fork head of FIG. 2.
Figure 5:
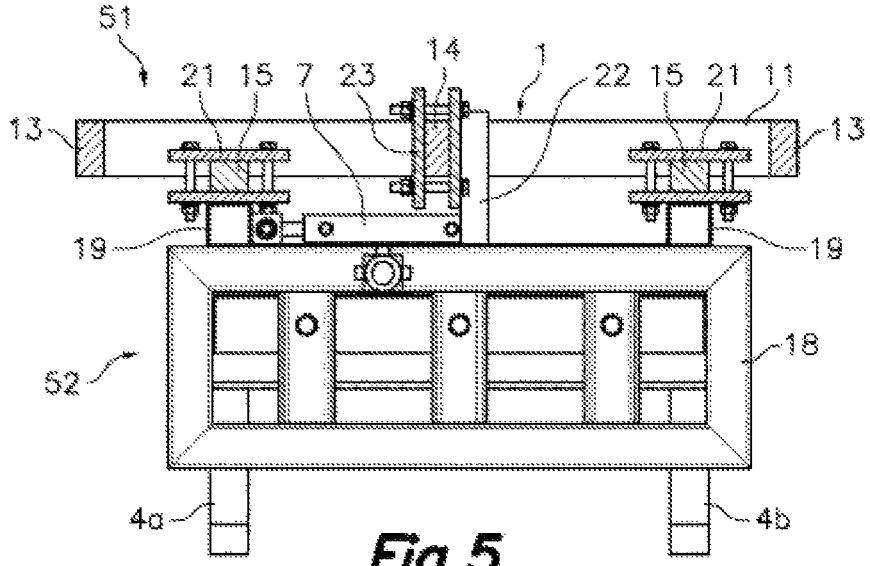
FIG. 5 is a partially sectioned bottom plan view of the fork head of FIG. 2.
Figure 7:
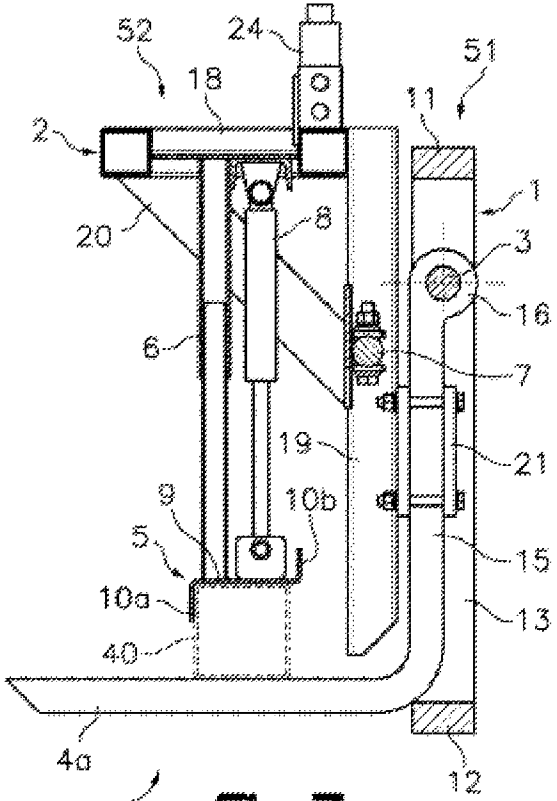
FIG. 7 is a transverse sectional side view of the fork head of FIG. 2 with the gripping member in the active position gripping a thin object.
Figure 6:
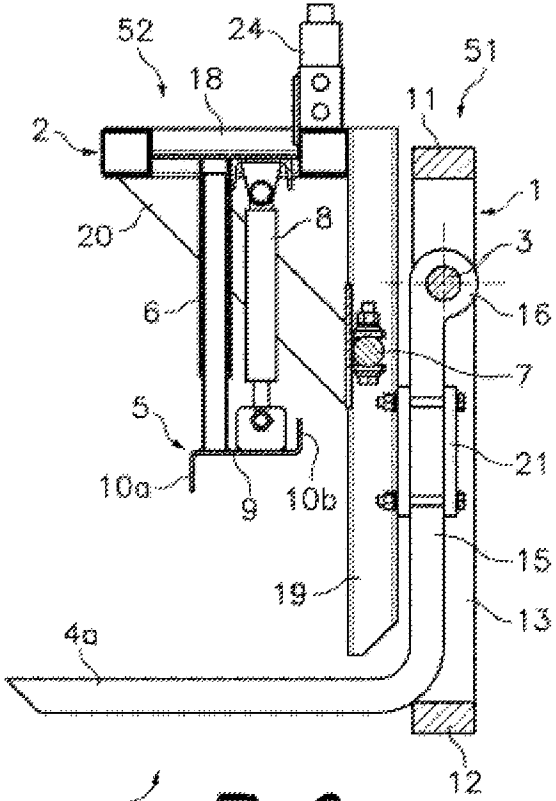
FIG. 6 is a transverse sectional side view of the fork head of FIG. 2 with the gripping member in the inactive position.

As best shown in FIGS. 3 and 4, in any embodiment of the present invention the gripping member 5 has a length L in the transverse direction Y equal to or greater than a fork width W defined as a distance between respective opposite outer edges of the two fork arms 4*a*, 4*b* in the transverse direction Y and, and further the gripping member 5 has end portions 5*a*, 5*b* superimposed on portions of the two fork arms 4*a*, 4*b*.

The term "thin object" is used in this description to mean an elongated object with a consistent transverse section with a large length relative to the size of its transverse section. FIG. 3 shows the fork head of the present invention with the gripping member 5 in an active position gripping a thin object consisting of a square profile tube such as those used for example as turning shafts in single-axis solar tracker apparatuses. By way of reference, these square profile tubes can have a transverse sectional size of about 150×150 millimeters, with varying wall thicknesses of between 3 and 6 millimeters, and with lengths of up to 13 meters. Alternatively, the thin objects may consist of square, round or any other shape of regular or irregular transverse section.

What is claimed is:

1. A fork head with a gripping and lateral movement device for gripping thin objects, comprising:

a main frame arranged to be fixed to a moving element of an elevator vehicle;

a mobile frame movable horizontally by a first actuator along a transverse guide fixed to the main frame;

two parallel fork arms fixed to the mobile frame;

a gripping member mounted on the mobile frame and movable by a second actuator to and from the fork arms for trapping a thin object in a hanging position between the gripping member and the fork arms, wherein:

the gripping member has a length (L) in a transverse direction equal to or greater than a fork width (W) defined as a distance between respective opposing outer edges of the fork arms; and the gripping member has end portions superimposed on the fork arms;

wherein the main frame defines a peripheral frame having an upper bar, a lower bar, two end posts and a central post extending from the upper bar to the lower bar;

wherein the upper bar and the lower bar are oriented in a transverse direction and the end posts and the central post are oriented in a vertical direction perpendicular to a longitudinal direction and to the transverse direction, wherein the transverse guide has two circular transverse sections extending from each of the end posts to the central post;

and wherein each fork arm is rigidly attached to one end of a respective vertical element having at its other end a connecting element provided with a circular opening through which the corresponding section of the transverse guide is inserted so that the fork arms can slide and pivot freely with respect to the transverse guide.

2. The fork head of claim 1, wherein said gripping member is movable along at least one linear guide fixed to the mobile frame.

3. The fork head of claim 2, wherein the linear guide is a telescopic guide having a guide body connected to the mobile frame and a telescopic rod connected to the gripping member, or a guide body connected to the gripping member and a telescopic rod connected to the mobile frame.

4. The fork head of claim 1, wherein the first actuator is a first hydraulic cylinder having a cylinder body connected to the main frame and an extendable rod connected to the mobile frame, or a cylinder body connected to the mobile frame and an extendable rod s connected to the main frame.

5. The fork head of claim 1, wherein the second actuator is a second hydraulic cylinder having a cylinder body connected to the mobile frame and an extendable rod connected to the gripping member, or a cylinder body connected to the gripping member and an extendable rod connected to the mobile frame.

6. The fork head of claim 1, wherein the gripping member comprises a pressure plate parallel to a support member plane defined by upper surfaces of the fork arms, wherein the pressure plate comprises a front skirt, perpendicular to the support member plane, and extending downwardly from a forward transverse edge of the pressure plate.

7. The fork head of claim 1, wherein the mobile frame comprises an upper horizontal structure and two rear posts oriented in the vertical direction, wherein the rear posts are fixed to the upper frame engaging with braces, wherein each of the rear posts has a first bracket configured to be attached to one of the vertical elements which in turn are attached to the fork arms so that the main frame is slidable and pivotable together with the fork arms along the transverse guide.

8. The fork head of claim 7, wherein the first actuator comprises a first hydraulic cylinder having a cylinder body connected to a support member which has a second bracket fixed to the central post of the main frame and an extendable rod connected to one of the rear posts of the mobile frame, or a cylinder body connected to the rear post and an extendable rod connected to the support member.

* * * * *